US007914318B2

(12) United States Patent
Stevenson et al.

(10) Patent No.: US 7,914,318 B2
(45) Date of Patent: Mar. 29, 2011

(54) ELECTRICAL CONNECTOR

(75) Inventors: Robin Stevenson, Bloomfield, MI (US); Jianying Shi, Oakland Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 136 days.

(21) Appl. No.: 12/277,801

(22) Filed: Nov. 25, 2008

(65) Prior Publication Data

US 2010/0130052 A1 May 27, 2010

(51) Int. Cl.
*H01R 13/64* (2006.01)

(52) U.S. Cl. ..... 439/374; 439/378

(58) Field of Classification Search ..... 439/374, 439/378, 247, 345, 362, 357, 680
See application file for complete search history.

(56) References Cited

U.S. PATENT DOCUMENTS

| | | | | |
|---|---|---|---|---|
| 4,664,456 | A * | 5/1987 | Blair et al. | 439/108 |
| 4,761,144 | A * | 8/1988 | Hunt et al. | 439/545 |
| 4,959,023 | A * | 9/1990 | Watanabe et al. | 439/595 |
| 5,391,091 | A * | 2/1995 | Nations | 439/378 |
| 5,605,150 | A * | 2/1997 | Radons et al. | 600/300 |
| 5,620,329 | A | 4/1997 | Kidd et al. | |
| 5,713,754 | A | 2/1998 | Samejima et al. | |
| 5,967,809 | A | 10/1999 | Fink et al. | |
| 6,155,857 | A | 12/2000 | Kato et al. | |
| 6,767,244 | B2 | 7/2004 | Saito | |
| 6,840,789 | B2 | 1/2005 | Shibata | |
| 6,848,925 | B2 | 2/2005 | Nishide | |
| 6,910,916 | B2 | 6/2005 | Murakami | |
| 7,189,101 | B2 | 3/2007 | Nagashima et al. | |
| 7,229,308 | B2 | 6/2007 | Ishikawa | |

FOREIGN PATENT DOCUMENTS

| | | |
|---|---|---|
| JP | 2000123916 A | 4/2000 |
| JP | 2001093620 A | 4/2001 |

* cited by examiner

*Primary Examiner* — Xuong M Chung Trans
(74) *Attorney, Agent, or Firm* — Quinn Law Group, PLLC

(57) ABSTRACT

An electrical connection system includes a first electrical connector having a first plurality of electrically conductive elements. A second electrical connector has a second plurality of electrically conductive elements and is matable with the first electrical connector such that the first plurality of electrically conductive elements are in contact with the second plurality of electrically conductive elements. A probe is mounted with respect to the first electrical connector, and a receptacle is mounted with respect to the second electrical connector. The probe has a tip, an untapered section, a tapered section between the tip and the untapered section, and a cross-sectional shape that has no more than one plane of mirror symmetry. The receptacle defines a cavity having substantially the same cross-sectional shape as the probe.

12 Claims, 2 Drawing Sheets

ELECTRICAL CONNECTOR

TECHNICAL FIELD

This invention relates to electrical connectors having self-alignment features.

BACKGROUND OF THE INVENTION

Automotive vehicles typically include several electronic devices that must receive electrical energy to operate, and that sometimes must send and receive electrical signals to other electronic devices. Wiring harnesses are typically used to provide conductive pathways through the vehicle for transmission of electrical power and signals among electronic devices and power sources such as batteries. Wiring harnesses typically include a plurality of electrical connectors that are engaged with corresponding connectors on the electronic devices during automotive assembly.

One type of electrical connector includes conductive elements, e.g. pins, that are engageable with sockets on a corresponding type of electrical connector to establish electrical communication between an electronic device and the wiring harness. Maximizing the density of the conductive elements minimizes the size of the electrical connector and thus improves packaging efficiency. However, maximizing the density of the conductive elements, by minimizing their size, reduces their mechanical strength and thus the ability of the conductive elements to sustain nonaxial loads due to misalignment of the two connectors during insertion of the conductive elements into the corresponding sockets.

A shroud typically surrounds the pins to protect them from nonaxial loads, and is often used to align the sockets with the pins during the mating of the two electrical connectors.

SUMMARY OF THE INVENTION

An electrical connection system includes a first electrical connector having a first plurality of electrically conductive elements. A second electrical connector has a second plurality of electrically conductive elements and is matable with the first electrical connector such that the first plurality of electrically conductive elements are in contact with the second plurality of electrically conductive elements.

A probe is mounted with respect to the first electrical connector, and a receptacle is mounted with respect to the second electrical connector. The probe has a tip, an untapered section, and a tapered section between the tip and the untapered section. At least part of the probe has a cross-sectional shape that has no more than one plane of mirror symmetry. The receptacle defines a cavity having substantially the same cross-sectional shape as the probe.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
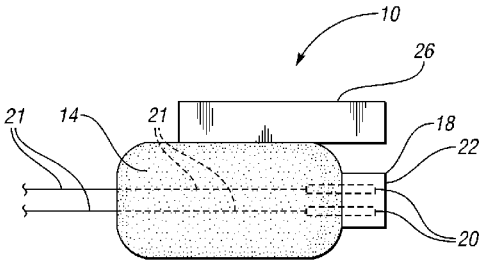
FIG. 1 is a schematic, side view of a male electrical connector having a receptacle.

Referring to FIG. 1, an electrical connector 10 includes a housing 14. The electrical connector 10 also includes a shroud 18 that protects a first plurality of conductive elements, which are pins 20 in the embodiment depicted, that protrude from the housing 14. Each of the pins 20 is electrically conductive, and is in electrical communication with a respective wire 21. As understood by those skilled in the art, each pin is operatively connected to its respective wire inside the housing 14. The wires 21 extend outside of the housing 14; the wires 21 may be bundled together outside of the housing 14 to form a cable, as understood by those skilled in the art. The shroud 18 is characterized by an opening 22 at its forward end to provide access to the pins 20. The electrical connector 10 also includes a receptacle 26 for aligning and guiding a corresponding electrical connector (shown at 28 in FIG. 2).

Figure 2:
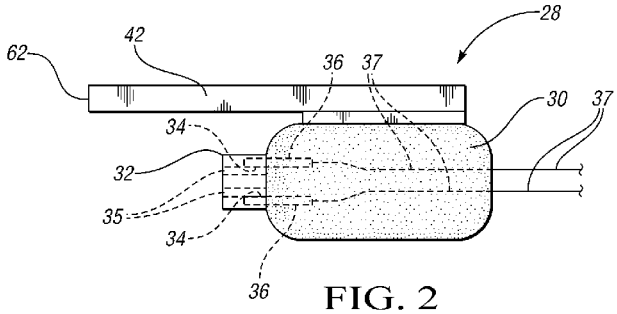
FIG. 2 is a schematic, side view of a female electrical connector that is engageable with the mail electrical connector of FIG. 1 and that has a probe that is insertable into the receptacle for guiding and aligning the female electrical connector.

Referring to FIG. 2, electrical connector 28 includes a housing 30 having a member 32 protruding therefrom. Member 32 defines a plurality of sockets 34. Each of the sockets 34 has a respective opening 35 so that the sockets 34 are forwardly open to receive the pins (shown at 20 in FIG. 1). The sockets 34 are sufficiently spaced and oriented so that, when the electrical connector 28 is sufficiently aligned with the electrical connector shown at 10 in FIG. 1, each of the pins 20 of connector 10 is insertable within a respective one of the sockets 34.

The electrical connector 28 includes a second plurality of electrically conductive elements, which, in the embodiment depicted, are electrical contacts 36. Each of the contacts 36 is in electrical communication with a respective wire 37 inside the housing 30. The wires 37 extend outside of the housing 30. Each contact 36 is exposed to a respective one of the sockets 34 such that, when the pins 20 are within the sockets 34, each pin 20 is in contact with a respective one of the contacts 36, and, therefore, each of wires 21 is in electrical communication with a respective one of wires 37. Electrical connector 28 also includes a probe 42 mounted to the housing 30.

Figure 3:
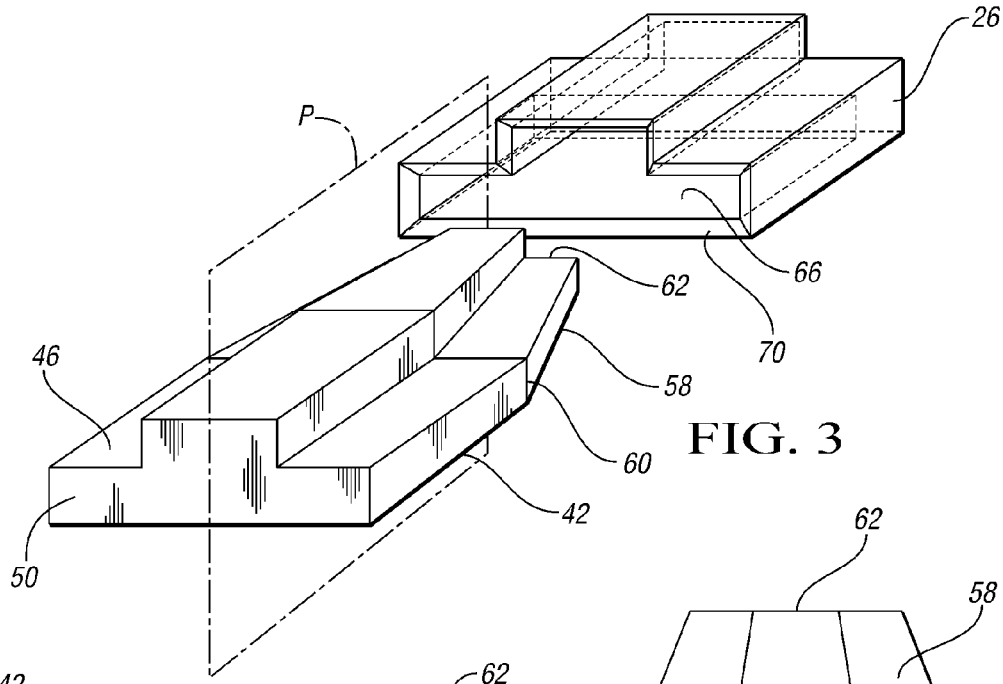
FIG. 3 is a schematic, perspective view of the probe and the receptacle.
Figure 4:
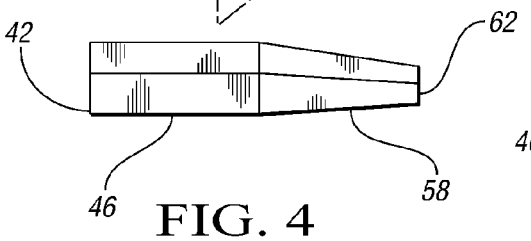
FIG. 4 is a schematic, side view of the probe.
Figure 5:
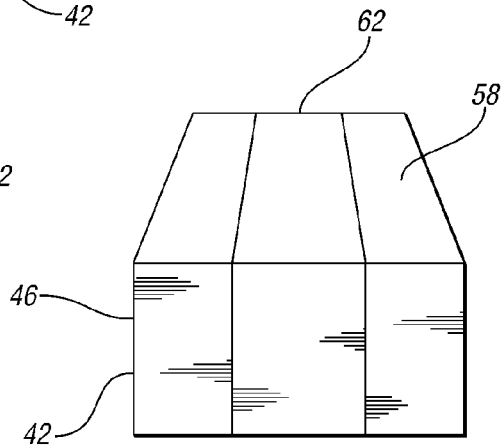
FIG. 5 is a schematic, top view of the probe.

Referring to FIGS. 3-5, wherein like reference numbers refer to like components from FIGS. 1 and 2, the probe 42 is characterized by an untapered section 46 having a constant cross-sectional shape 50 and constant dimensions along its length. As used herein, a cross-sectional shape refers to the shape of the probe as seen in cross-section taken about a plane that is perpendicular to the length of the probe, i.e., its greatest dimension. The probe 42 is characterized by a T-shaped cross section (shown as an inverted "T" in FIG. 3). The shape 50 is characterized by only a single plane P of mirror symmetry, i.e., the shape is symmetrical (mirror) about only one plane P.

The probe 42 is also characterized by a tapered section 58, which extends from a boundary 60 with the untapered section 46 to the forward tip 62 of the probe 42. The tapered section 58 is characterized by the same cross-sectional shape as the untapered section 46. However, although the cross-sectional shape of the tapered section 58 does not change between the boundary 60 and the tip 62, the cross-sectional dimensions and area of the tapered section 58 get progressively smaller between the boundary 60 and the tip 62. Thus, cross-sectional area at the forward tip 62 is smaller than at the untapered section 46.

Referring specifically to FIG. 3, receptacle 26 defines a cavity 66 that is characterized by the same cross-sectional shape as the probe 42. The cavity 66 is characterized by an opening 70 at its forward end for receiving the probe 42. The cross-sectional size of the cavity 66 is slightly larger than the cross-sectional size of the untapered section 46 of the probe 42 so that the probe 42 is insertable into the cavity 66 through the opening 70.

The opening 70 is characterized by the same cross-sectional shape as the probe 42. The opening 70 is tapered such that the forwardmost end of the opening 70 is larger than the rearward end of the opening 70 and the cavity 70. Referring again to FIG. 2, the probe 42 extends significantly forward of the housing 30, the member 32, and the contacts 36 so that the probe 42 is the most forwardly extending portion of the electrical connector 28. The length of the probe 42 enables the tapered section (shown at 58 in FIGS. 3-5) to be aggressively tapered to facilitate insertion of the probe 42 into the receptacle 26, even if there is significant linear or angular misalignment between the probe 42 and the opening 70 and cavity 66. The cross-sectional shape of the probe 42 prevents rotational misalignment and enables the use of only a single probe 42 and a single receptacle 26.

Figure 6:
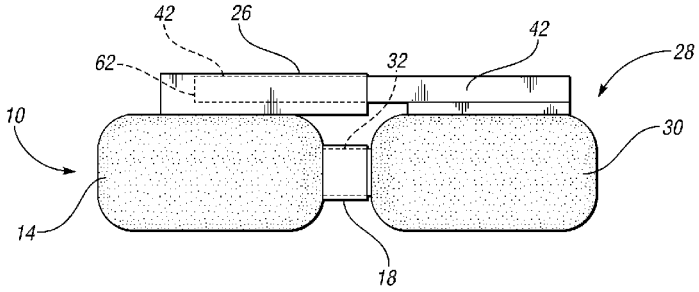
FIG. 6 is a schematic, side view of the male electrical connector of FIG. 1 engaged with the female electrical connector of FIG. 2.

The receptacle 26 guides the electrical connector 28, via probe 42, into engagement with electrical connector 10, as shown in FIG. 6. More specifically, and with reference to FIGS. 1-3 and 6, the cavity 66 is sufficiently positioned and shaped such that, as the probe 42 is further inserted into the cavity 66 through opening 70, the interaction between the walls of the cavity 66 and the probe 42 limits movement of the electrical connector 28 such that the member 32 enters the opening 22 of shroud 18, and each of the pins 20 enters a respective one of the sockets 34 via one of the opening 35. Each pin 20 contacts a respective contact 36, thereby establishing electrical communication between wires 21 and wires 37.

Figure 7:
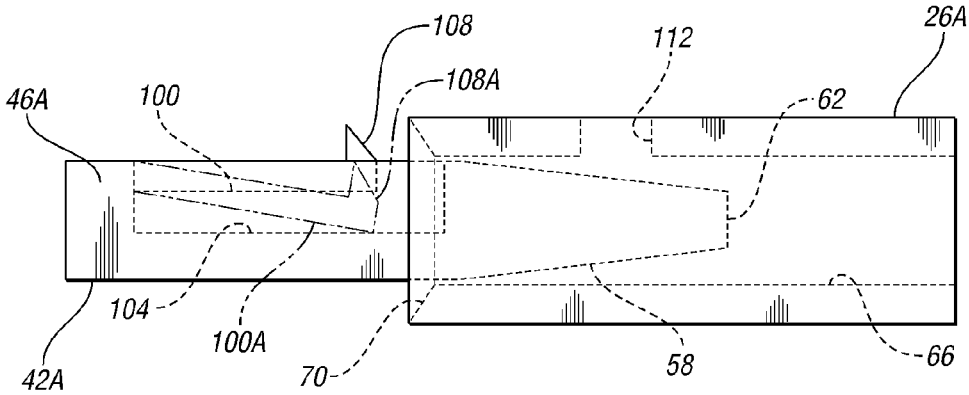
FIG. 7 is a schematic, side view of an alternative probe and receptacle in accordance with the claimed invention.

Referring to FIG. 7, wherein like reference numbers refer to like components from FIGS. 1-6, an alternative probe 42A and receptacle 26A configuration is schematically depicted. The probe 42A includes a flexible arm 100 extending above a cavity 104. A projection 108 extends from one end of the arm 100 and is positioned to contact the receptacle 26A at the opening 70. As the probe 42A is inserted into the opening, the receptacle 26A acts on the projection 108, urging the projection 108 and the arm 100 into the cavity 104, as shown at 100A, 108A. A notch 112 is formed in the upper surface of cavity 66. The upper surface of cavity 66 maintains the projection in the position shown at 108A until the projection is aligned with the notch 112. Once the projection 108 is aligned with the notch 112, the elastic property of the arm 100 urges the projection into the notch 112, thereby locking the probe 42A with respect to the receptacle 26A.

It should be noted that, although various members of the electrical connectors (shown at 10 and 28 in FIGS. 1 and 2) are shown as separate pieces mounted with respect to each other, the members may be formed from a single piece of material within the scope of the claimed invention. For example, the receptacle 26 may be integrally formed with the housing 14, and the probe 42 may be integrally formed with the housing 30 and/or member 32 within the scope of the claimed invention.

The electrically conductive elements are shown in the embodiment depicted as pins 20 and contacts 36. Those skilled in the art will recognize a variety of electrically conductive element configurations that may be employed within the scope of the claimed invention. For example, electrically conductive elements may include flat plates, cylindrical members, etc., within the scope of the claimed invention. Furthermore, and within the scope of the claimed invention, electrically conductive elements may define the sockets of the female electrical connector.

While the best modes for carrying out the invention have been described in detail, those familiar with the art to which this invention relates will recognize various alternative designs and embodiments for practicing the invention within the scope of the appended claims.

The invention claimed is:

1. An electrical connection system comprising:

a first electrical connector having a first plurality of electrically conductive elements;

a second electrical connector having a second plurality of electrically conductive elements and being matable with the first electrical connector such that the first plurality of electrically conductive elements are in contact with the second plurality of electrically conductive elements;

a probe being mounted with respect to the first electrical connector;

a receptacle being mounted with respect to the second electrical connector;

said probe having a tip, an untapered section, and a tapered section between the tip and the untapered section; and said receptacle defining a cavity having substantially the same cross-sectional shape as the probe;

wherein at least part of the probe has a cross-sectional shape that has no more than one plane of mirror symmetry;

wherein the cross sectional shape of the probe does not vary along the length of the tapered portion;

wherein the cross sectional shape is generally T-shaped.

2. The electrical connection system of claim 1, wherein the cavity is sufficiently positioned and shaped such that, when the probe is sufficiently inserted into the cavity, the first plurality of conductive elements are aligned with the second plurality of conductive elements so that further insertion of the probe into the cavity causes contact between the first plurality of conductive elements and the second plurality of conductive elements.

3. The electrical connection system of claim 2, wherein the tapered and untapered sections are characterized by the same cross-sectional shape.

4. The electrical connection system of claim 2, wherein the tip of the probe is forward of the second plurality of contacts.

5. The electrical connection system of claim 4, wherein the probe extends farther forward than any other part of the first electrical connector.

6. The electrical connection system of claim 1, wherein the probe includes a projection sufficiently positioned to be displaced by the receptacle during insertion of the probe into the cavity.

7. The electrical connection system of claim 6, wherein the receptacle defines a notch positioned to receive the projection when the probe is sufficiently inserted into the cavity.

8. The electrical connection system of claim 2, wherein the first electrical connector includes a member defining a plurality of sockets;

wherein the second plurality of conductive elements is a plurality of pins;

wherein the second electrical connector includes a shroud surrounding the pins and defining an opening;

wherein, when the first and second electrical connectors are engaged with one another, the member extends through the opening of the shroud, and each of the pins is within a respective one of the sockets;

wherein the probe is sufficiently long such that the tip of the probe enters the cavity of the receptacle before the member that defines the sockets enters the opening of the shroud.

9. An electrical connection system comprising:

a first electrical connector having a plurality of electrical contacts and a member that defines a plurality of sockets;

a second electrical connector having a plurality of pins;

a probe being mounted with respect to one of the first and second electrical connectors;

a receptacle being mounted with respect to the other of the first and second electrical connectors;

said probe having a tip, an untapered section, a tapered section between the tip and the untapered section, and a cross-sectional shape that has no more than one plane of mirror symmetry; and said receptacle defining a cavity having a cavity opening and having substantially the same cross-sectional shape as the probe;

wherein the cross sectional shape of the probe does not vary along the length of the tapered portion;

wherein the cross sectional shape is generally T-shaped.

10. The electrical connection system of claim 9, wherein the cavity is sufficiently positioned and shaped such that, when the probe is sufficiently inserted into the cavity, the first plurality of conductive elements are aligned with the second plurality of conductive elements so that further insertion of the probe into the cavity causes contact between the first plurality of conductive elements and the second plurality of conductive elements.

11. The electrical connection system of claim 10, wherein the tapered and untapered sections are characterized by the same cross-sectional shape.

12. The electrical connection system of claim 9, wherein the tip of the probe extends farther forward than any other portion of the electrical connector to which the probe is operatively connected.

* * * * *